US005338510A

United States Patent [19]

Zuech

[11] Patent Number: 5,338,510

[45] Date of Patent: Aug. 16, 1994

[54] CAST ALUMINUM ALLOY AND TOOLING FIXTURE THEREFROM

[76] Inventor: Romeo A. Zuech, 6238 Orcutt Rd., San Luis Obispo, Calif. 93401

[21] Appl. No.: 130,777

[22] Filed: Oct. 4, 1993

[51] Int. Cl.[5] ..... C22C 21/10; C22C 21/12

[52] U.S. Cl. ..... 420/532; 148/417

[58] Field of Search ..... 420/532, 533, 538, 541; 148/417, 439

[56] References Cited

U.S. PATENT DOCUMENTS 2,357,452 9/1944 Bonsack ..... 420/532

4,169,728 10/1979 Takeuchi et al. ..... 420/532

FOREIGN PATENT DOCUMENTS 160811 6/1933 Switzerland ..... 420/532

604813 7/1948 United Kingdom ..... 420/532

*Primary Examiner*—Melvyn J. Andrews

*Assistant Examiner*—Margery S. Phipps

[57] ABSTRACT

A cast aluminum alloy and tooling fixture fabricated therefrom is provided which can be produced in thicknesses up to 32.0 inches; and which has equiaxed grains, an ultimate tensile strength above 30,000 psi after annealing, is dimensionally stable, and is free from porosity. The alloy has a nominal composition of 3.0% copper, 2.2% zinc, 0.7% nickel, 1.0% magnesium, 1.2% iron, 0.3% manganese, and balance aluminum. The alloy is direct water chill cast followed by a stress relieving anneal.

3 Claims, No Drawings

CAST ALUMINUM ALLOY AND TOOLING FIXTURE THEREFROM

BACKGROUND OF THE INVENTION

1. Field of the Invention

This invention relates to cast aluminum alloys, and particularly to dimensionally stable aluminum alloy castings and to tooling fixtures therefrom.

2. Description of Related Art

Aluminum base alloys made for tooling applications are known. For example, aluminum products producers are commercially producing aluminum tooling plates with alloys containing zinc, copper, magnesium and silicon as major elements; and iron, nickel, manganese and chromium as impurities. The above materials are cast but generally are not equiaxially grained and maximum thickness availability is only 4.0 inches.

Other aluminum alloys containing zinc, copper and magnesium as major constituents (7000 aluminum series) are well known but are available only in the wrought form (hot rolled). These alloys have the typical wrought elongated and distorted grain structure that is very dense and very strong but has poor dimensional stability because of grain directionality. All wrought 7000 series aluminum alloys require a solution heat treatment, a water quench and a precipitation hardening treatment (aging) to achieve their mechanical properties.

The direct water cooled casting method is also known. It is universally used to produce aluminum billets that are subsequently worked into wrought aluminum products such as plates, bars, extrusions and forgings. It is also a well-known fact that this mechanical working of the original cast grain structure, although producing high mechanical properties after heat treatment, produces too much grain directionality to be dimensionally stable.

SUMMARY OF THE INVENTION

It is an object of the invention to provide an aluminum alloy casting which is dimensionally stable.

It is an object of the invention to provide an aluminum alloy casting which has no internal porosity.

It is an object of the invention to provide an aluminum alloy casting which can be annealed to provide both dimensional stability and high strength for thicknesses up to at least 32.0 inches.

It is an object of the invention to provide dimensionally stable, strong tooling fixtures from aluminum castings.

These and other objects and features of the invention will be apparent from the following detailed description.

DESCRIPTION OF THE PREFERRED EMBODIMENTS

The chemical composition of the aluminum base alloy of this invention is the result of considerable studies and experiments. Major objectives were for the alloy to be completely stress relieved but at the same time have good mechanical properties, be porosity free and be available in thickness from 0.25 inches to 32.0 inches.

Complete stress relieving can be accomplished only by annealing, a process where the material is generally heated to 750 F. and air cooled. Annealing greatly reduces the strength of practically all aluminum alloys. For example, aluminum alloy 6061, a commonly used high strength wrought alloy, when fully heat-treated (T6) has an ultimate tensile strength of 44,000 psi, a yield strength of 40,000 psi and 10% elongation. When annealed, the ultimate tensile of strength of alloy 6061 drops to 18,000 psi and the yield drops to 8,000 psi with an elongation of 25%

In contrast an aluminum alloy cast plate made in accordance with the present invention, still retains good mechanical properties after all of the residual stresses are removed by annealing. Typical mechanical properties of the annealed casting for thicknesses from 0.25 inch to 32.0 inches are: 32,000 psi ultimate tensile strength, 16,000 psi yield strength and 8.0% elongation.

The alloy described in the present invention is normally not heat-treated (other than annealing), but if heat-treated to the T6 condition would result in 40,000 psi ultimate tensile strength, 34,000 psi yield strength and 6.0% elongation. Note that the ultimate tensile strength in the fully annealed condition is only 8,000 psi less than in the heat treated T6 condition. This is one of the significant improvements that the alloy of the present invention has over all other aluminum alloys.

The various amounts of alloying elements that make an aluminum alloy are generally selected to achieve various preferred characteristics. For example, high strength alloys all have some amounts of hardening constituents such as $Mg_2Si$ for 6061, $CuAl_2$-AlCuMg for 2024 and $MgZn_2$AlCuMg for 7075. These alloys are hardened by a solution heat treatment (8–12 hrs. at 900–1000 F.), a water quench and an aging cycle (6–24 hrs. at 250–350 F.). Note that the above heat treatment has a water quench step. This abrupt change in temperature results, in all cases, in uneven thermal contraction that results in the detrimental residual stresses that causes poor dimensional stability.

Uneven cooling during the water quench makes it impossible to have a uniform cooling rate in the center of thick materials. Uneven cooling results in uneven response to hardening. Maximum material thickness for heat-treatable wrought alloys is 8.0 inches for 6061 and 4.0 inches for 7075.

Cast aluminum tooling plates produced with the present invention are completely free from any residual stresses that can cause warpage, and have dense and uniform equiaxial grains all the way up to 32.0 inches in thickness. Consequently the plates offer high dimensional stability. For example, a plate having a dimension of 144 inches in length, 40 inches in width and 0.5 inch in thickness has a flatness that can be maintained within 0.005 inch for the complete span of the plate.

The chemical composition invented to obtain these desirable properties comprises an aluminum base alloy containing (by weight): 1.5–6.0% copper, 0.5– 4.5% zinc, 0.2–1.5% nickel, 0.2–1.5% iron, 0.2–1.8% magnesium, and 0.05–1.2% manganese.

Silicon, chromium, and titanium may be present as impurities and generally speaking should be kept below 0.2% total.

In a preferred embodiment, closer compositional tolerances are specified as follows: 2.8–3.2% copper, 2.0–2.4% zinc, 0.6–0.8% nickel, 1.0–1.4% iron, 0.8–1.2% magnesium, and 0.2–0.4% manganese.

The most preferred or target composition of the alloy is: 3.0% copper, 2.2% zinc, 0.7% nickel, 1.0% magnesium, 1.2% iron, 0.3% manganese, and balance aluminum.

The most preferred chemical composition was invented to produce an aluminum alloy meeting the previously mentioned objectives (thickness availability, microstructure, dimensional stability, mechanical properties and freedom from porosity). From a physical metallurgy standpoint, the most critical objective was to obtain microstructure that retained good strength even after being fully annealed. All of the elements, copper, zinc, nickel, iron, magnesium and manganese contribute to this objective by creating a series of mostly unsoluble intermetallic compounds that, because of the limited solubility, create good resistance to intergranular slippage.

The nickel, iron and manganese content are particularly effective by forming insoluble compounds such as $Al_{10}Fe_3Ni$, $MnAl_6$, and $Al_7Cu_2Fe$. Copper is needed for castability and, together with nickel and iron, reduces the solidification brittleness (hot shortness) by increasing the hot strength. Magnesium and zinc, both, add strength by dispersion hardening although they are partially dissolved during annealing.

The aluminum base alloy is melted in a conventional gas furnace. The main ingredient is aluminum 99.6% pure with a maximum of 0.4% iron and silicon total impurities.

The zinc and magnesium content are added in the pure form, but rather than adding pure copper, nickel, iron and manganese, these elements are added in the form of aluminum master alloys.

For example, the aluminum-copper master alloy may contain 33% copper by weight and 67% aluminum by weight. This master alloy has a melting point of 1018 F. which is lower than the melting point of aluminum (1220 F.) or pure copper (1980 F.). The melting furnace temperature is generally set at 1280 F.

Before entering the mold, the liquid metal goes through a filtering box where detrimental gasses (mostly hydrogen) are removed by being treated with nitrogen gas. The metal then is slowly dropped into a rectangular water cooled mold. The base of the mold is continually dropped, thus creating long, rectangular plates with a typical length of 16 feet. Density and uniformity of a cast aluminum alloy mostly depends on the solidification speed. The faster the speed, the denser the metal. The direct water cooled casting process, even when used to make extra thick material (32.0 inches) solidifies the liquid aluminum in only a few seconds, thus guaranteeing high density throughout. This casting operation in constructed in a conventional manner using available technology.

Typical thickness of plates produced directly from the rectangular water cooled molds are 6.0 inches, 12.0 inches, 18.0 inches, 24.0 inches, and 32.0 inches. Plates with a thickness below 6.0 inches are cut to the desired thickness (after the anneal process described below) by a sawing operation. For example, seven 0.75 inch thick plates can be obtained from a 6.0 inch cast plate.

The cast plates are then subjected to a special annealing process, specifically designed for the aluminum alloy part of this invention. This process consists of heating for 8–12 hrs. at about 850 F. and furnace cooling at the very slow rate of 75 F. per hour. This special process completely stress relieves the material and at the same time, because of the specially devised chemical composition, results in good strength.

After annealing, the cast plates are machined into the desired tooling fixture configuration. Because the castings are completely stress relieved, they do not distort or warp during the machining operation. Additionally, they maintain the finish machined dimension because of their stress-free, stable, equiaxed grain structure.

Castings produced in accordance with the present invention are desirable for many applications which require a dimensionally stable alloy with a tensile strength of up to about 30,000 psi. Thus, the castings are particularly suitable for tooling fixtures (such as tooling plates and jigs) which are defined as devices for holding and positioning workpieces during cutting or forming operations. Other applications include dies and permanent molds for plastics. Accordingly, it should be understood that the form of the invention described above is illustrative and is not intended to limit the scope of the invention.

What is claimed is:

1. An aluminum base casting alloy consisting essentially of by weight: 1.5–6% copper, 0.5–4.5% zinc, 0.2–1.5% nickel, 0.2–1.5% iron, 0.2–1.8% magnesium, 0.05–1.2% manganese, and remainder aluminum and minor impurities.

2. An aluminum base casting alloy consisting essentially of, by weight: 2.8–3.2% copper, 2.0–2.4% zinc, 0.6–0.8% nickel, 1.0–1.4% iron, 0.8–1.2% magnesium, 0.2–0.4% manganese, and remainder aluminum and minor impurities.

3. In a tooling fixture, an improvement comprising: a casting consisting essentially of, by weight: 1.5–6.0% copper, 0.5–4.5% zinc, 0.2–1.5% nickel, 0.2–1.5% iron, 0.2–1.8% magnesium, 0.05–1.2% manganese and remainder aluminum and minor impurities; the casting having equiaxed grains and being substantially free of both porosity and residual stresses, and having an ultimate tensile strength of about 30,000 psi.

* * * * *